US006553970B1

(12) United States Patent
McCoy et al.

(10) Patent No.: US 6,553,970 B1
(45) Date of Patent: Apr. 29, 2003

(54) CONTROL OF DRIVER CURRENT VIA LOW SIDE GATES

(75) Inventors: John C. McCoy, Fayetteville, TN (US); Lou Vierling, East Detroit, MI (US)

(73) Assignee: Siemens VDO Automotive Corporation, Auburn Hills, MI (US)

( * ) Notice: Subject to any disclaimer, the term of this patent is extended or adjusted under 35 U.S.C. 154(b) by 261 days.

(21) Appl. No.: 09/703,537

(22) Filed: Nov. 1, 2000

Related U.S. Application Data

(60) Provisional application No. 60/162,837, filed on Nov. 1, 1999.

(51) Int. Cl.[7] ..... F02M 51/00

(52) U.S. Cl. ..... 123/490; 123/472; 361/152

(58) Field of Search ..... 123/490, 491, 123/472, 478; 361/152, 153

(56) References Cited

U.S. PATENT DOCUMENTS 4,605,983 A 8/1986 Harvey
5,515,830 A * 5/1996 Arakowa ..... 123/490
5,558,065 A * 9/1996 Arakawa ..... 123/490
5,992,391 A * 11/1999 Yamakado et al. ..... 123/490
6,213,099 B1 * 4/2001 Calvas et al. ..... 123/490
6,332,453 B1 * 12/2001 Yamakado et al. ..... 123/490
6,332,455 B1 * 12/2001 Sumida et al. ..... 123/490

FOREIGN PATENT DOCUMENTS

| | | |
|---|---|---|
| DE | 19854789 | 8/1999 |
| EP | 0460660 | 12/1991 |
| EP | 0813069 | 12/1997 |

* cited by examiner

*Primary Examiner*—John Kwon

(57) ABSTRACT

A fuel injector coil control circuit includes high side and low side gates. The current through the coil is increased while being monitored by low side shunt circuitry. The current continues to increase until a predetermined value is reached. When the predetermined value is reached, the low side gate is switched off and the current begins to decay. The off time of the low side gate is controlled for a predetermined period of time. After the predetermined period of time elapses, the low side gate is switched back on, causing the current to rise again toward the predetermined value.

20 Claims, 4 Drawing Sheets

CONTROL OF DRIVER CURRENT VIA LOW SIDE GATES

RELATED APPLICATIONS

This application claims priority to U.S. Provisional Patent Application Ser. No. 60/162,837, filed Nov. 1, 1999.

BACKGROUND OF THE INVENTION

The present invention relates to a method and apparatus for controlling fuel injectors.

Fuel injectors are used to assist in the injection of fuel during the operation of a diesel engine. A fuel injector includes two coils: an open coil and a close coil. To inject fuel into the cylinder, it is necessary to first activate the open coil and then the close coil.

In present designs, each coil includes a high side gate and a low side gate. The injector current is monitored by a low side shunt to ground. The high side gate, connected to the supply voltage, switches off when the injector coil current reaches a desired value. Inductive energy stored in the coil is dissipated by a diode to ground. The low side shunt monitors this decaying current and when it reaches a preset level, the high side gate is turned back on and the coil current starts rising again. The measurement of the current on the low side and the control of it at the high side require level shifting of either the inputs to the drivers or the sensor signals. Also, for applications requiring overlap between the activation of the open and close coils on the same cylinder, measuring on the low side and chopping on the high side results in a system (for an eight cylinder engine) that requires a minimum of eight high side gates and will not allow the use of three wire injectors (where the open and close coils share a lead).

SUMMARY OF THE INVENTION

The fuel injector control circuit of the present invention eliminates the necessity of controlling the current on one side and measuring it on the other side. In the present invention, the current to the coil is increased while being monitored by the low side shunt circuitry. The current continues to increase until it reaches the predetermined threshold value. When the predetermined threshold value is reached, the low side switch is switched off and the current begins to decay. Rather than measuring the current during this decay, the low side gate is switched off for a predetermined period of time. When the predetermined period of time elapses, the low side gate is switched back on, causing the current to rise again toward the predetermined value.

Since the falling current is not measured, only timed, the current at the end of the timed cycle may be higher or lower than desired. This is compensated by the rising portion of the cycle where the current is measured. For example, if the delay was too long, and a current dropped too low, the rising current would be on longer, bringing it back up. Likewise, if the delay is too short, causing the current to drop too little, the rising current will be on less, bringing it back to the predetermined value.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
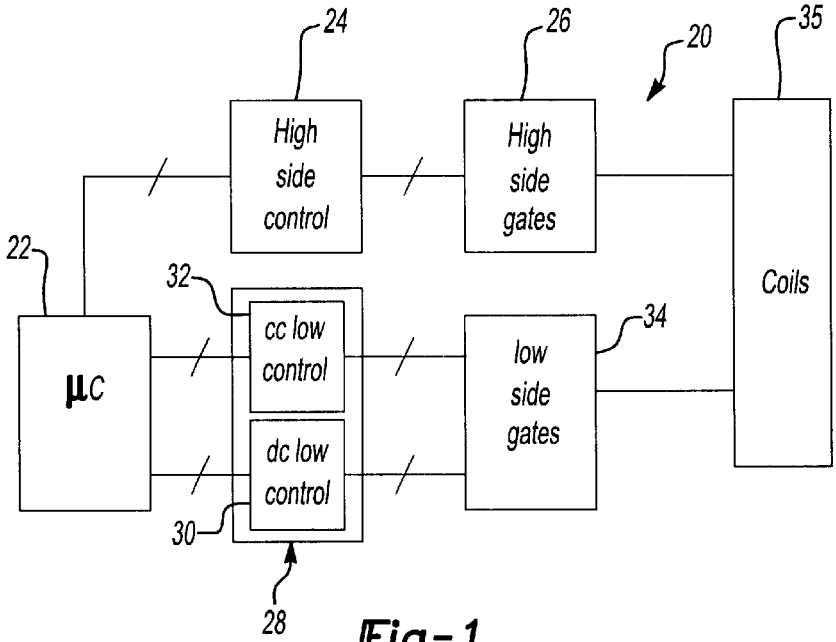
FIG. 1 is a high level schematic of the fuel injector coil control circuitry of the present invention.

FIG. 1 is a high level schematic of the fuel injector coil control circuitry 20 of the present invention. Generally, the fuel injector coil control circuitry 20 includes a microcontroller 22 sending control signals to high side gate control circuitry 24, which in turn sends control signals to high side gates 26. Further, the microcontroller 22 sends a plurality of control signals to low side gate control circuitry 28, which in turn comprises open coil low side gate control circuitry 30 and close coil low side gate control circuitry 32. The open coil and close coil low side gate control circuitry 30, 32 send a plurality of signals to the low side gates 34. As is known, selective activation of the high side gates 26 and low side gates 34 activates and deactivates fuel injector coils 35.

Although two possible arrangements will be described below for the high side gates 26, the present invention deals primarily with the operation of the low side gates 34, and more particularly to the control of the low side gates 34 by the low side gate control circuitry 28. Additional detail regarding the operation of the high side control circuitry 24 and other possible arrangements of the high side gates 26 are described in more detail in copending application U.S. Ser. No. 09/704,227, filed on the same date as this application, the assignee and inventors of which are the assignee and inventors of the present application, and which is hereby incorporated by reference in its entirety as though repeated fully herein. Of course, the inventive control of the low side gates described herein could alternatively be used for controlling the high side gates. Microcontroller 22 is to be programmed to perform the operations described herein. Such programming is fully within the ability of one skilled in the art.

Figure 2:
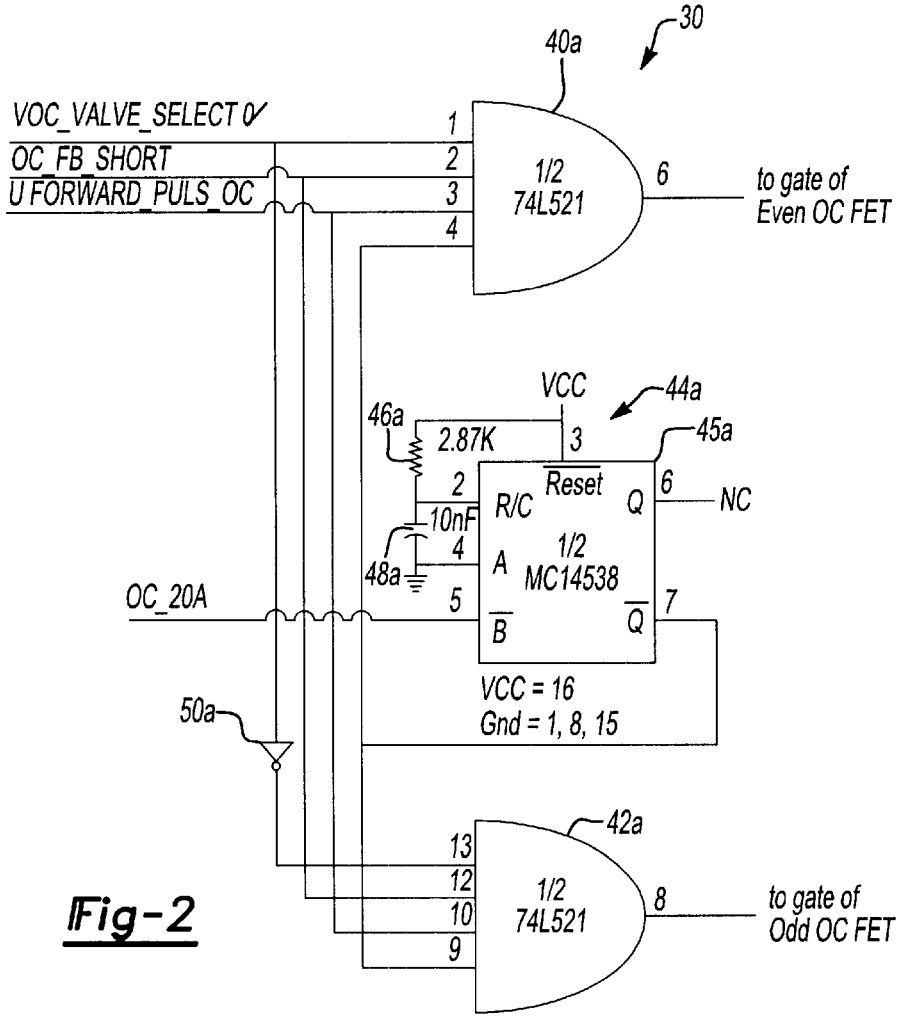
FIG. 2 is a schematic of the open coil low side gate control circuitry of FIG. 1.
Figure 3:
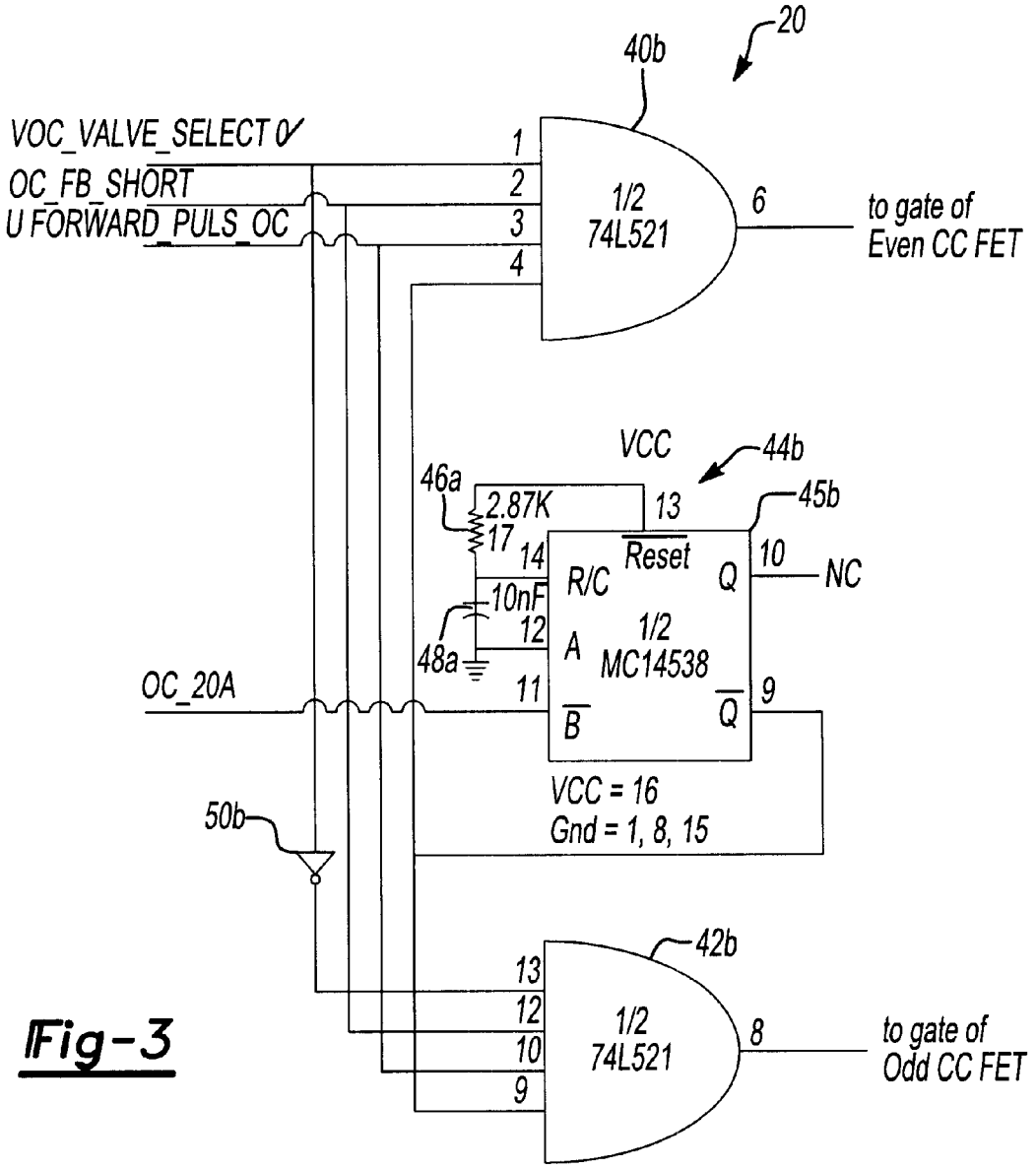
FIG. 3 is a schematic of the close coil low side gate control circuitry of FIG. 1.

FIGS. 2 and 3 illustrate in more detail the open coil low-sided gate control circuitry 30 and close coil low-sided gate control circuitry 32, respectively. As can be seen, the open coil low side gate control circuitry 30 and close coil low side gate control circuitry 32, are structurally identical. Thus, components in these circuits 30, 32 will be described with identical reference numerals, with the suffix "a" indicating a component in open coil low side gate control circuitry 30 and the suffix "b" indicating a component in the close coil low side gate control circuitry 32.

Each includes a first AND gate 40*a, b* generating an output to the even FET (or other type of switch). Further, each includes a second AND gate 42*a, b* generating an output to the odd FET (or other type of switch). Each control circuitry 30, 32 further includes timing circuitry, which in this case is preferably a one-shot 44*a, b*. The one-shot 44*a, b*, as is well known, includes a flip flop 45*a, b* and an appropriate RC circuit, including resistor 46*a, b* and a capacitor 48*a, b*, selected to provide the appropriate elapsed period of time before the one-shot decays. Of course, the timing will depend upon the particular application of the present invention.

The inputs to the AND gates 40*a, b*, 42*a, b* are as follows. First, the first AND gates 40*a, b* receive valve_select0 signals from the microcontroller 22 (FIG. 1). This simply indicates whether an even or odd injector is currently being activated. Thus, the valve_select0 signal is inverted by invertors 50*a, b* prior to being input to the second AND gates 42*a, b*, respectively.

Second, each AND gate 40*a, b*, 42*a, b*, receives an input indicating whether a short is detected, which would switch off the appropriate gates. Third, the timing of the pulses is controlled by a forward_pulse signal from microcontroller 22 (FIG. 1) (separately for open coil and close coil). The signal is also sent to all of AND gates 40*a, b*, 42*a, b*. Finally, each of the AND gates, 40*a, b*, 42*a, b*, receives an input from the timing circuitry of 44*a, b*, respectively. The timing circuitry is initiated by an input (OC_20 A or CC_20 A) indicating that the current through the coil has exceeded a predetermined value (in this case 20 amps).

The operation of the timing circuitry 44*a, b*, will be described more in context below. When the timing circuitry 44*a* is activated by an indication that the current through the appropriate coil has exceeded the predetermined value, the circuitry 45*a, b* is set, closing the output_Q switching off both AND gates 40*a, b*, 42*a, b*, thereby switching off the appropriate low side gate. The appropriate low side gate is switched off until the timing circuitry 44*a, b* times out based upon the RC circuitry 46*a, b*, 48*a, b*, and the output_Q goes high, switching the AND gates 40*a, b*, 42*a, b* back on and switching the appropriate low side gate back on. It should be noted that the current through the coil is not measured while the gate is turned off. Rather, the gate is simply switched off for a predetermined period of time.

The open coil and close coil low side gate control circuitry 30, 32 of FIGS. 2 and 3, can be used with many different arrangements of gates for controlling activation and deactivation of coils. Two possible examples are shown in FIGS. 4 and 5, but other arrangements could also be utilized.

Figure 4:
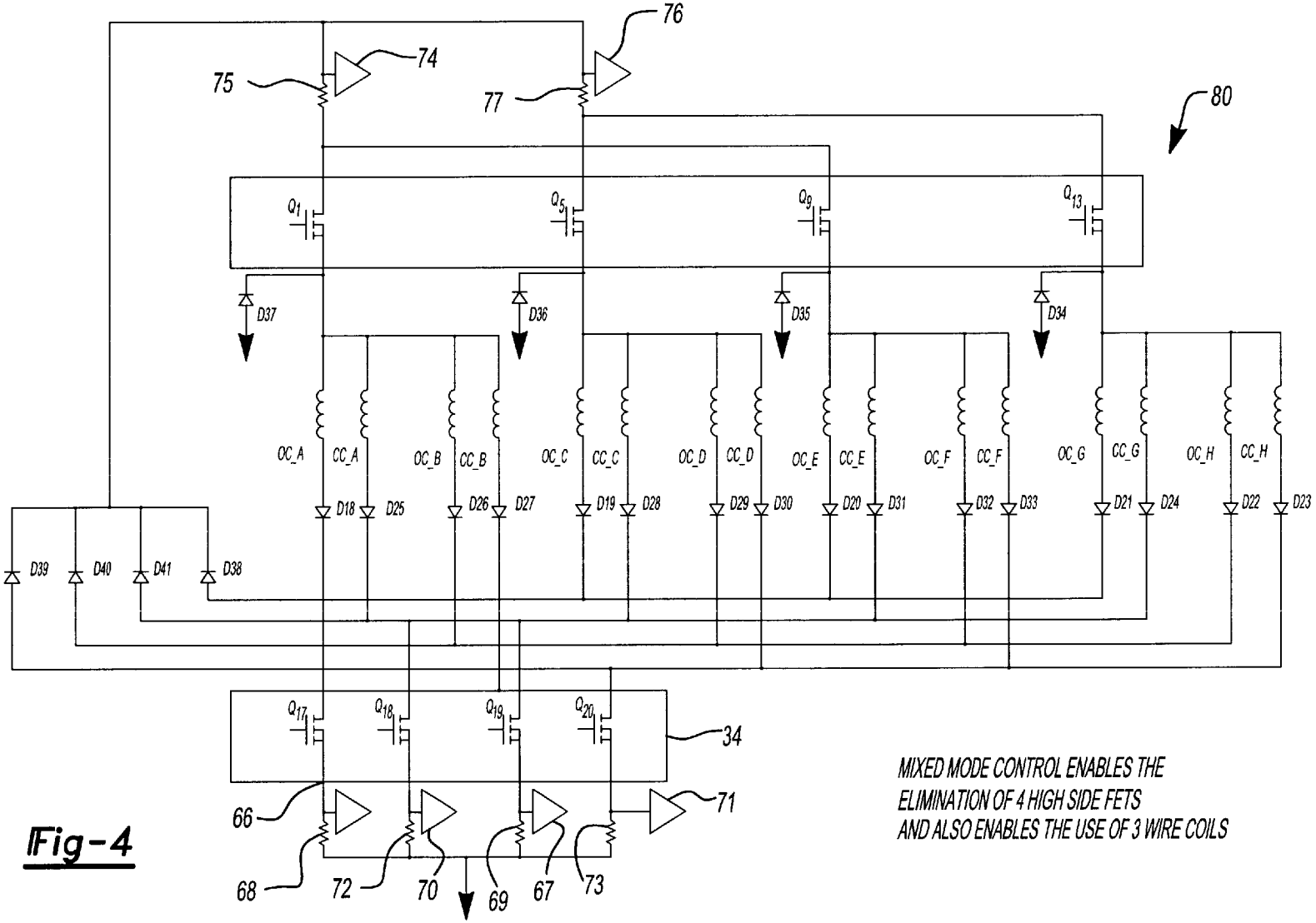
FIG. 4 illustrates one possible arrangement of the high and low side gates of FIG. 1, which could be used with the control circuitry of the present invention.
Figure 5:
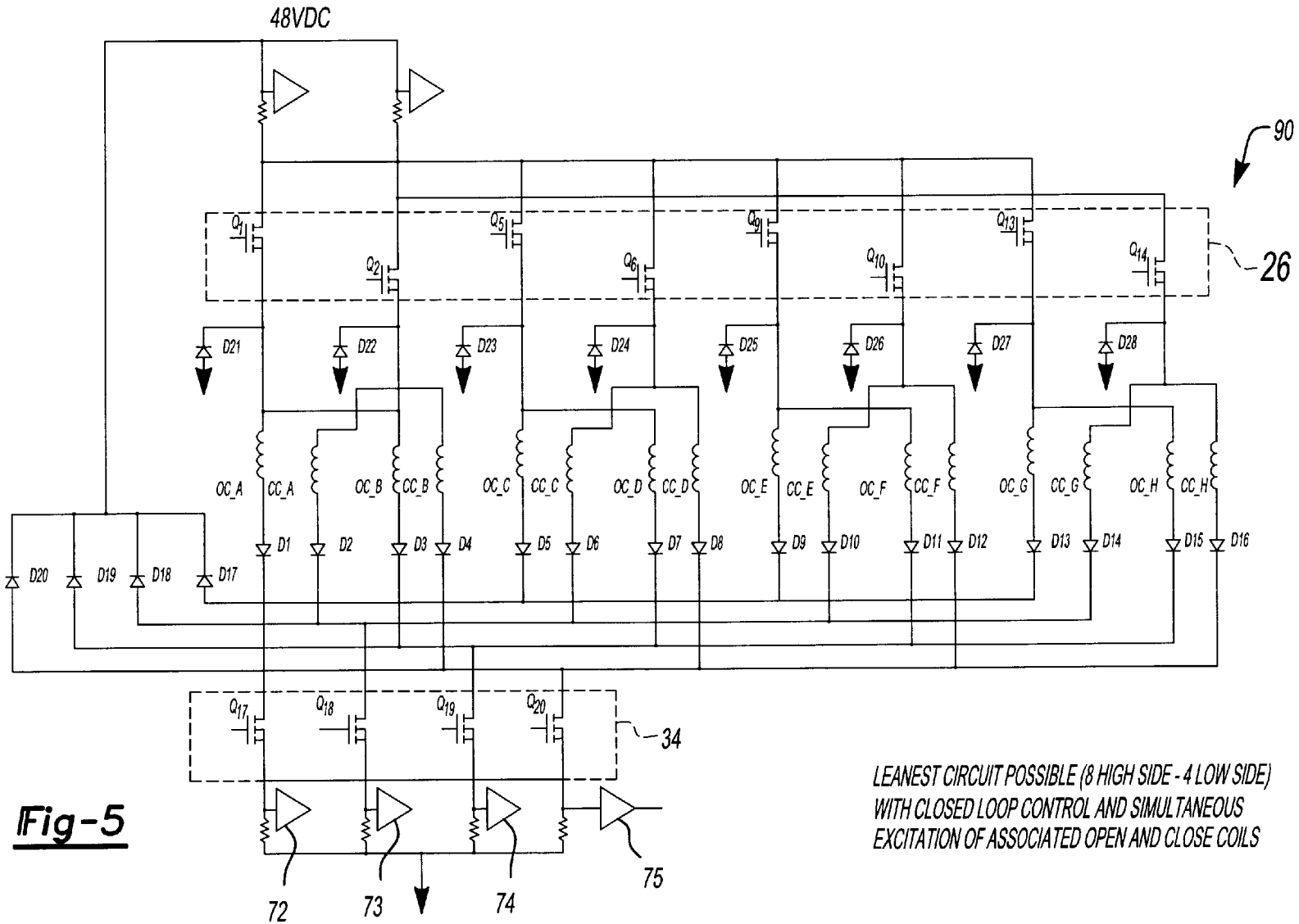
FIG. 5 is a schematic of a second possible arrangement of the high and low side gates of FIG. 1, which could be utilized with the control circuitry of the present invention.

FIG. 4 illustrates a fuel injector coil circuit 80, including high side gates 26 and low side gates 34. The low side gates 34 would be controlled by the circuitry of FIGS. 2 and 3. The fuel injector coil circuitry 80 of FIG. 4 is shown for an eight-cylinder engine, each cylinder (A–H) having an injector (not shown), an open coil O_A-H and a close coil CC_A-H, respectively. In this fuel injector coil circuit 80 of FIG. 4, there are four high side gates: Q1, Q5, Q9 and Q13, which are shown as FETs, but which could be other gates or switches. Each high side gate selectively connects the voltage supply to an even and an odd pair of open coils and close coils.

Similarly, the low side gates Q17–20 are also shown as FETs, but could also be other types of gates. In FIG. 4, gate Q17 selectively connects the odd open coils to ground. Q18 connects the odd close coils to ground. Gate Q19 selectively connects the even open coils to ground and gate Q20 selectively connects the even close coils to ground. Thus, gate Q17 would receive the output of AND gate 42A of FIG. 2. Q18 would receive the output of AND gate 42*b* of FIG. 3. Gate Q19 would receive the output of AND gate 40*a* of FIG. 2 and gate Q20 would receive the output of AND gate 40*a* of FIG. 2.

In circuitry 80, the signal OC_20 A of FIG. 2 indicating that the predetermined value of the current has been reached is provided by comparators 66, 67, measuring voltage across shunt resistors 68, 69, respectively, for the open coil current. Comparators 70, 71 and shunt resistors 72, 73 provide the communication that the current through the close coils has exceeded the predetermined value. Similarly, comparator 74 along with shunt resistor 75 and comparator 76 along with shunt resistor 77, indicate the occurrence of a short, for example, at 30 amps or greater.

In operation, the high side gates 26 and low side gates 34 are selectively activated to activate selected coils OC_A-H, CC_A-H. For example, when the current through coil OC_A exceeds a predetermined value as determined by comparator 66, the timing circuitry 44*a* is switched causing_Q to go low, thereby switching off AND gate 42*a*, which thereby switches off gate Q17. After the RC circuitry 46*a*, 48*a* has decayed, the flip flop 45*a* is set, causing_Q to go high, thereby switching AND gate 42*a* back on, as well as low side gate Q17. In this manner, the low side gate Q17 is switched off based upon the current exceeding a predetermined value, and is switched back on after a predetermined period of time. The other low side gates would operate similarly.

The present invention provides its current control through the coils without having to control the current on one side and measure it on the other side. After the low side gate is switched off, the present invention does not measure the current during the decay of the current, rather the off time of the low side gate is controlled for a predetermined period of time. When the timing circuitry times out, the low side gate is switched back on, causing the current to rise again to the predetermined value.

It should be recognized that, since the falling current is not measured, but only timed, the current at the end of the timed cycle may be higher or lower than desired. This is compensated for by the rising portion of the cycle where the current is measured. If the delay was too long, and the current dropped too low, the rising current will be on longer bringing it back up. Likewise, if the delay is too short, causing the current to drop too little, the rising current will be on less, bringing it back to the predetermined value.

FIG. 5 illustrates an alternate fuel injector coil control circuit 90, which could be utilized with the present invention. The circuit 90 includes a different arrangement of the high side gates 26, and includes twice as many. However, the operation of the low side gates 34, is identical to that described above with respect to FIG. 4. It should be recognized that further arrangements of the coils and gates 26, 34 could also be utilized with the present invention.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A fuel injector control circuit comprising:

at least one coil for controlling the operation of an injector;

at least one switch selectively activating said at least one coil;

a timing circuit switching said switch on based upon the expiration of a predetermined time.

2. The fuel injector control circuit of claim 1, wherein said switch selectively connects said at least one coil to ground.

3. The fuel injector control circuit of claim 1, wherein said switch is a FET.

4. The fuel injector control circuit of claim 1, wherein said timing circuit is a one-shot.

5. The fuel injector control circuit of claim 4, wherein the one-shot switches said switch based upon the expiration of the predetermined time.

6. The fuel injector control circuit of claim 5, wherein said at least one coil comprises a plurality of coils.

7. The fuel injector control circuit of claim 5, wherein said predetermined time starts based upon current through said switch exceeding a predetermined value.

8. A method for controlling a fuel injector including the steps of:

(a) Activating a coil to control a fuel injector;

(b) Deactivating the coil to control the fuel injector; and (c) Switching from said step (b) to said step (a) based upon the lapse of a predetermined period.

9. The method of claim 8, further including the steps of:

(d) Measuring current through the coil;

(e) Comparing the current measured in said step (d) to a threshold current; and (f) Beginning the predetermined time period based upon said step (c).

10. The method of claim 9, further including the step of:

(g) Opening a switch based upon said step (e).

11. The method of claim 10, further including the step of:

(h) Closing the switch after the lapse of the predetermined time period.

12. A fuel injector control circuit comprising:

at least one coil for controlling the operation of a fuel injector;

at least one high side gate selectively connecting the at least one coil to a ground, and a timing circuit switching a selectively activated one of the at least one high side gate and the at least one low side gate based upon the expiration of a predetermined time and being activated based upon a current through the selectively activated gate reaching a predetermined threshold.

13. The fuel injector control circuit of claim 12 wherein the selectively activated gate is the at least one low side gate.

14. The fuel injector control circuit of claim 13 wherein the at least one low side gate is opened based upon the current reaching the predetermined threshold.

15. The fuel injector control circuit of claim 14 wherein the at least one low side gate is closed by the timing circuit based upon the expiration of a predetermined time.

16. The fuel injector control circuit of claim 12 wherein the selectively activated gate is opened based upon the current reaching the predetermined threshold.

17. The fuel injector control circuit of claim 16 wherein the selectively activated gate is closed by the timing circuit based upon the expiration of a predetermined time.

18. The fuel injector control circuit of claim 17 wherein the at least one coil comprises a plurality of coils, the at least one high side gate comprises a plurality of high side gates and the at least one low side gate comprises a plurality of low side gates, and wherein each of the plurality of high side gates selectively connects more than one of the plurality of coils to the power supply.

19. The fuel injector control circuit of claim 18 wherein each of the plurality of low side gates selectively connects more than one of the plurality of coils to ground.

20. The fuel injector control circuit of claim 1 wherein the switch is switched off based upon current through the switch reaching a predetermined threshold.

* * * * *